US006012262A

United States Patent [19]

Irving

[11] Patent Number: 6,012,262

[45] **Date of Patent: *Jan. 11, 2000**

[54] BUILT-UP I-BEAM WITH LAMINATED FLANGE

[75] Inventor: David C. Irving, Boise, Id.

[73] Assignee: Trus Joist MacMillan, Boise, Id.

[ * ] Notice: Under 35 U.S.C. 154(b), the term of this patent shall be extended for 580 days.

[21] Appl. No.: 08/615,820

[22] Filed: Mar. 14, 1996

[51] Int. Cl.[7] ..... E04C 3/14

[52] U.S. Cl. ..... 52/729.4; 52/730.7

[58] Field of Search ..... 52/729.4, 730.7

[56] References Cited

U.S. PATENT DOCUMENTS

| | | | |
|---|---|---|---|
| Re. 30,636 | 6/1981 | Barnes . | |
| 2,397,936 | 4/1946 | Glidden et al. . | |
| 2,429,235 | 10/1947 | Miskelly et al. . | |
| 2,446,304 | 8/1948 | Roman . | |
| 2,485,587 | 10/1949 | Goss . | |
| 2,545,603 | 3/1951 | Byers et al. . | |
| 2,773,789 | 12/1956 | Clark . | |
| 2,773,790 | 12/1956 | Clark . | |
| 2,776,686 | 1/1957 | Clark . | |
| 2,835,622 | 5/1958 | Clark . | |
| 2,854,372 | 9/1958 | Yan et al. . | |
| 2,876,153 | 3/1959 | Dorland et al. . | |
| 3,164,511 | 1/1965 | Elmendorf . | |
| 3,202,743 | 8/1965 | Elmendorf . | |
| 3,287,855 | 11/1966 | Hallonquist et al. . | |
| 3,447,996 | 6/1969 | Himmelheber et al. . | |
| 3,887,406 | 6/1975 | Gwynne . | |
| 3,956,555 | 5/1976 | McKean . | |
| 3,969,459 | 7/1976 | Fremont et al. . | |
| 4,061,819 | 12/1977 | Barnes . | |
| 4,074,498 | 2/1978 | Keller et al. | 52/729.4 |
| 4,112,162 | 9/1978 | Casselbrant . | |
| 4,122,236 | 10/1978 | Holman . | |
| 4,195,462 | 4/1980 | Keller et al. | 52/729.4 |
| 4,241,133 | 12/1980 | Lund et al. . | |
| 4,246,310 | 1/1981 | Hunt et al. . | |
| 4,255,477 | 3/1981 | Holman . | |
| 4,361,612 | 11/1982 | Shaner et al. . | |
| 4,363,883 | 12/1982 | Gagliani et al. . | |
| 4,364,984 | 12/1982 | Wentworth . | |
| 4,404,252 | 9/1983 | Hetzler et al. . | |
| 4,411,548 | 10/1983 | Tschan . | |
| 4,413,031 | 11/1983 | Poppelreuter . | |
| 4,479,912 | 10/1984 | Bullock . | |
| 4,492,726 | 1/1985 | Rosenberg . | |
| 4,494,919 | 1/1985 | Knudson et al. . | |
| 4,715,162 | 12/1987 | Brightwell | 52/729.4 |
| 4,751,131 | 6/1988 | Barnes . | |
| 4,967,534 | 11/1990 | Lines | 52/729.4 |
| 4,974,389 | 12/1990 | Onysko et al. | 52/730.7 |
| 5,059,466 | 10/1991 | Blümer . | |
| 5,323,584 | 6/1994 | Scarlett | 52/729.4 |

FOREIGN PATENT DOCUMENTS

| | | |
|---|---|---|
| 519621 | 12/1955 | Canada . |
| 565840 | 11/1958 | Canada . |
| 597584 | 5/1960 | Canada . |
| 597587 | 5/1960 | Canada . |
| 597941 | 5/1960 | Canada . |
| 622691 | 6/1961 | Canada . |
| 631284 | 11/1961 | Canada . |
| 669089 | 8/1963 | Canada . |
| 778849 | 2/1968 | Canada . |
| 1182266 | 2/1985 | Canada . |
| 1227961 | 10/1987 | Canada . |
| 93154 | 12/1959 | Czechoslovakia . |

*Primary Examiner*—Michael Safavi
*Attorney, Agent, or Firm*—Kolisch Hartwell Dickincon McCormack & Heuser

[57] ABSTRACT

An I-beam for use in construction, built-up from a web held between a pair of laminated flanges. Each flange includes a first laminate made of oriented strand lumber and a second laminate laminated to the first laminate. The web is between the first laminates.

19 Claims, 1 Drawing Sheet

BUILT-UP I-BEAM WITH LAMINATED FLANGE

FIELD OF THE INVENTION

This invention relates generally to I-beams formed of engineered lumber for use in residential and commercial construction.

BACKGROUND OF THE INVENTION

I-beams are used in residential and commercial construction as the joists in ceilings and floors, often instead of more conventional rectangular sawn lumber joists, such as 2-by-12's. An I-beam is a beam that includes what are called flanges as the top and bottom of the "I," and what is called a web as the body of the I, between the top and bottom flanges. The strength of an I-beam depends on what it is made of, what shape it has, and how well its parts are attached to each other. For example, an I-beam made of steel is usually stronger than the same beam made of wood, and an I-beam with a tall web usually is stronger than a beam with a short web made with the same size flanges and same thickness of web.

An I-beam used in a floor or ceiling is often selected based on how much the beam flexes or moves when it is in use. A beam may move a lot without breaking, so that a floor made with this beam might not collapse, but might move so much that it feels springy, making it very awkward for anyone walking or sitting on the floor, and can cause its holding nails to loosen and squeak. A bouncing or squeaking floor is disturbing to those both above and below the floor. Thus, a good I-beam is strong enough not to flex or squeak excessively. For floors and ceilings in occupied areas, an acceptable amount of movement is generally less than 1/360th of the span. The span is the distance the beam extends without any support. For a 10-foot span, this means the beam can only flex about 1/3-inch at any point on the beam.

When an I-beam is flexed under a load, some parts of the beam are being squeezed under compression, and other parts are being pulled under tension. The flanges are under the most compression or tension because they are being squeezed by or pulled along the web as it is bent into a curved shape. The taller the web, the more this squeezing or pulling acts on the flanges for a given amount of bending of the web, which is why taller I-beams are stronger than shorter ones. The technical term describing this is the moment of inertia of the beam, which expresses the ability of a beam to resist flexing. The higher the moment of inertia, the more a beam resists flexing. In an I-beam, the combination of the web and the flanges creates a beam with a relatively high moment of inertia, even though the moment of inertia of the web or flanges, separately, is relatively low.

Steel I-beams can be extruded out of a single piece of material, in much the same way as children's clay is pressed through an I-shaped hole to form a long I-shaped piece. The same could be done with wood by cutting the I-beam from a single, solid piece of wood, but this would be very wasteful of the wood. Furthermore, wood and other wood-based materials often have different strengths in different directions. Thus, wood-based I-beams are made from several separate pieces that are glued, nailed or pressed together. These beams are called "built-up I-beams" because they are built from several different pieces of material.

One example of a known built-up I-beam is manufactured by Trus Joist MacMillan a Limited Partnership of Boise, Id., and is disclosed in U.S. Pat. No. 4,893,961. This beam is made from a web of plywood or oriented strand board (OSB) and flanges of laminated strand lumber (LSL) or laminated veneer lumber (LVL). A groove or rout is cut into the lower or upper face of each flange, and the flanges are glued to the web by forcing the web into the rout in each flange. While the dimensions can vary, one such I-beam with an overall height of 11⅞-inches is made with a web that is 7/16-inches thick by 10½-inches high, and matching flanges that are 1½-inches thick by 2 5/16-inches wide. The rout bisects the width of each flange and penetrates to about half of the thickness of the flange, so that the web extends about half the way through each flange.

Plywood, OSB, LSL, and LVL are part of a broad range of manmade lumber materials referred to as engineered lumber. The advantages of using engineered lumber for I-beams include the general uniformity of the material, resulting in more predictable structural performance of the beam, and the availability of high quality engineered lumber of the needed dimensions compared to the availability of conventional sawn lumber of the same dimensions. Other types of engineered lumber, including parallel strand lumber (PSL), glued laminated timber (GLT) and particleboard have varying degrees of applicability to I-beams.

The distinguishing factors between the above-mentioned types of engineered lumber generally involve the types, sizes and relative orientations of fiber used, the types and proportions of adhesives used, and the methods of forming the fiber and adhesive into a finished product. OSB, as used herein, refers only to engineered lumber incorporating selectively oriented strands of wood fiber that are bonded with adhesive cured in a hot platen press. The press is normally of a fixed size, operating in a batch process, but may also be a continuously operating belt-type press. Actually, when dealing with structural components other than the web of an I-beam, the proper terminology is "oriented strand lumber" and not "oriented strand board." Therefore, oriented strand lumber or OSL will be used to describe this oriented strand product bonded with adhesive cured in a hot platen press. But because some still may refer to this product as oriented strand board or OSB, those terms should be considered herein to be synonymous with oriented strand lumber or OSL.

OSL is distinguished from LSL by OSL's hot platen press, as opposed to LSL's steam injection press. OSL is similarly distinguishable from PSL by PSL's unheated press that utilizes microwave energy to cure the adhesive instead of hot platens. However, OSL as used herein does encompass materials that may include fibers and adhesives similar to those used in LSL or PSL, provided the fibers and adhesives are formed into a finished product in a hot platen press. The remaining types of engineered lumber are made with fiber that is too short to provide the strength of strands, such as is found in particleboard, or too long to be processed as a strand, such as is found in plywood, LVL and GLT.

While the above-described OSB/LVL I-beam provides an adequate beam for most applications, there is an interest in the market for built-up beams with flanges made of materials other than LVL or LSL. However, simply replacing the LVL flanges in the Trus Joist MacMillan I-beam with flanges made of OSL does not provide a satisfactory beam. The combination of the distances traditionally spanned and the loads carried, particularly on longer spans, results in several structural inadequacies for an I-beam made with known OSL flanges.

One such inadequacy results because OSL is generally made in a batch process, in which adhesive and strands of wood fiber are mixed and placed in a press of a defined length to make panels of the desired thickness. The length is normally 24-feet, shorter than is required for many applications for built-up beams. While it is possible to join the edges of such panels with a finger joint to create a panel longer than 24-feet, finger joints often are not so strong as the remaining length of the OSL panel. Thus, the finger joint can create a point of failure. A similar problem can result because there are occasionally localized density variations in the OSL, such as a suboptimal concentration of adhesive relative to wood fiber, so that the OSL flange has weak points.

Another inadequacy results because of a density variation that occurs across the thickness of OSL made using hot platen press technology. A much higher density is found at the outside or skin of OSL than is found in the center or core. This means that the skin is harder than the core. Typically, the skin has a density of about 45-pounds per cubic inch and the core has a density of about 30-pounds per cubic inch. LSL and PSL do not have this density variation, and thus their use in beam flanges does not present the same technical problems as does the use of OSL in beam flanges.

When OSL is placed under a sufficiently high compression load, such as when the lower flange of an I-beam rests on a wall, the OSL may fail by crushing. The low density core crushes under a lower load than the high density outer skin. Typically, the core of thicker OSL crushes under lower loads than does the core of thinner OSL made with the same fibers and adhesives. OSL flanges should be about 1½-inches in thickness if they are to properly hold nails and other fasteners used to attach floors or ceilings to the beam. It has been found that OSL of this thickness tends to crush too easily to be used in many installations in which an I-beam joist is desired.

This crushing is accentuated by the use of a rout in the flanges, because the thickness of the web bears primarily against the low-density core of the OSL. The rout is used to improve the adhesion of the flange to the web, so non-routed flanges are not the solution to the problem addressed by the present invention. The angle of the rout could also be increased to broaden the flare of the rout, so that more of the compression is carried by the walls of the rout as opposed to the bottom of the rout. However, this would decrease the grip of the rout on the web as well, so this too is not the solution to the problem addressed.

Yet another drawback with using OSL flanges is the cost of OSL of the required thickness of 1½-inches. The cost of an OSL panel increases at a rate about proportional to the square of the thickness for most currently available manufacturing processes. Accordingly, 1½-inch-thick OSL is approximately four times as expensive as ¾-inch-thick OSL.

SUMMARY OF THE INVENTION

The present invention includes a new built-up I-beam for use in construction. The I-beam is built-up from a web held between a pair of laminated flanges. Each flange includes a first flange made of OSL and a second flange laminated to the inner flange. The web and first flanges are preferably held between the second flanges. The web normally extends more than halfway through the first flanges so that it bottoms out in a region of high density in each first flange. The second flanges may be of higher grade than the inner flanges and thereby provide greater resistance to tensile and compressive forces.

DETAILED DESCRIPTION OF THE PREFERRED EMBODIMENTS

Figure 1:
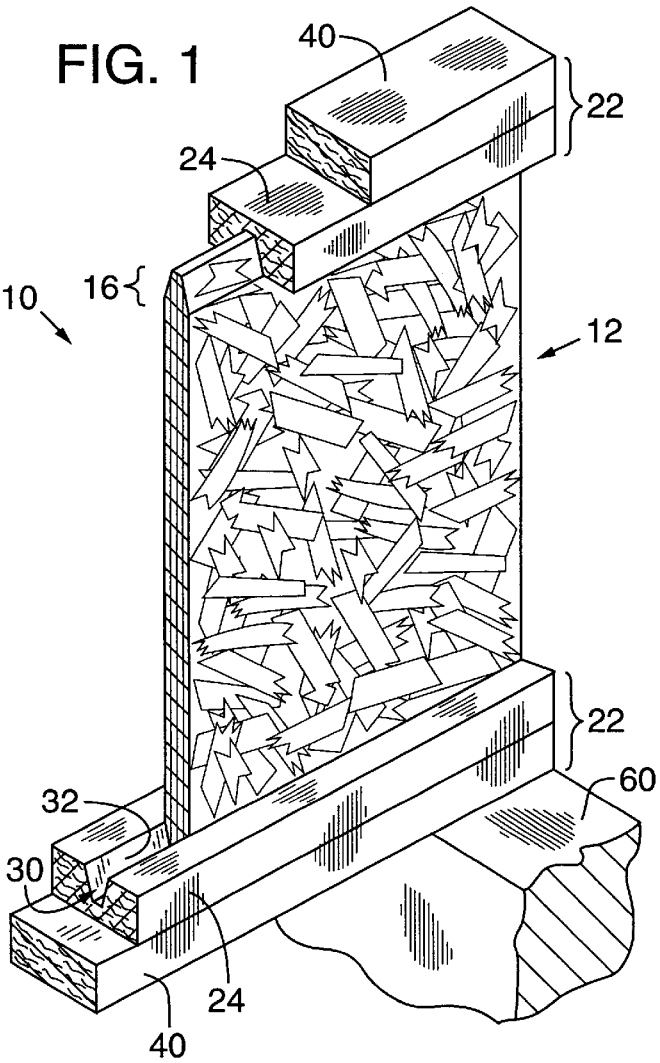
FIG. 1 is an isometric view of a short segment of the preferred embodiment of the beam of the present invention, shown resting on a support, with various elements of the beam being cutaway to show the details of the elements and the relationships between the elements.

Referring to the drawings, the preferred embodiment of a beam according to the present invention is indicated at 10. A longitudinal axis of beam 10 is indicated at 10*a* in FIG. 2. Beam 10 includes a web 12 interconnecting a pair of parallel flanges 22. The specifics of web 12 and flanges 22 are described below.

Figure 3:
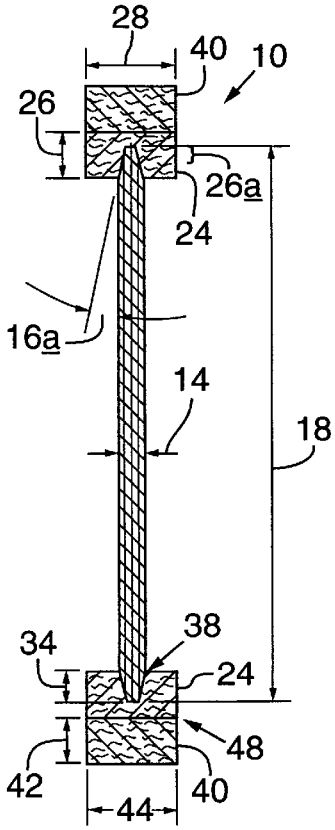
FIG. 3 is a cross-sectional end view of the beam shown in FIG. 2, taken generally along line 3—3 in FIG. 2.

Turning first to web 12, it has a thickness indicated at 14 (see FIG. 3) that is preferably tapered at the top and bottom of web 12, as indicated at 16, and a height indicated at 18. The preferred angle of taper 16 is about 3-degrees to 6-degrees as indicated in FIG. 3 by 16*a*. Web 12 is preferably made of OSL, with any convenient orientation of the strands. Web 12 alternatively could be made of plywood. In either case, panel joints 20 may be necessary to create a panel of sufficient length to form web 12. Panel joints 20 may be finger joints, butt joints or serrated joints, as desired. The strength of beam 10 does not appear to depend on the type or placement of panel joints 20.

Turning now to flanges 22, each includes at least an inner flange 24 and an outer flange 40, discussed below. Inner flange 24 has a thickness 26 with a core region indicated at 26*a*, and a width 28. Inner flange 24 is preferably made of OSL and could be made using conventional strand orientations such as random-oriented strands or cross-oriented strands. Preferably, the OSL for inner flange 14 would have an aligned orientation with the strands oriented to be about parallel, within about 20-degrees of longitudinal axis 10*a*. Thickness 26 is preferably about ¾-inch, and width 28 is selected as needed to provide the appropriate strength for beam 10, generally less than about 4-inches.

Figure 2:
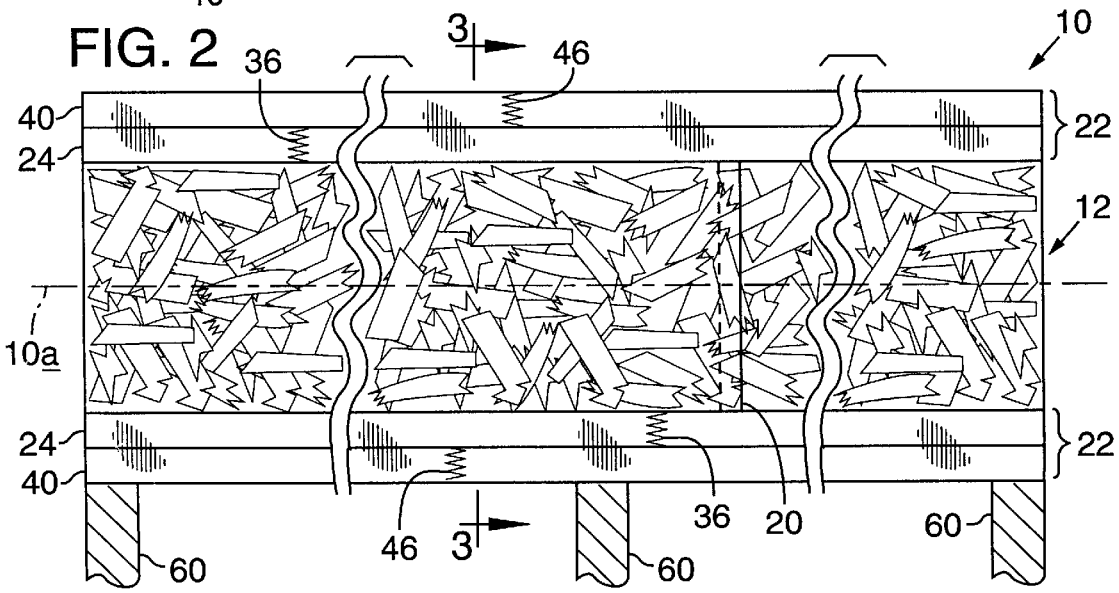
FIG. 2 is an front elevation of the beam in FIG. 1, shown resting on several supports, with the ends and a middle portion of the beam being shown.

A groove or rout 30 (see FIG. 1) having tapered sides 32 is formed in inner flange 24, with a rout depth 34 (FIG. 2). Tapered sides 32 preferably conform to taper 16 of web 12, but rout 30 is slightly undersized relative to taper 16 to create an interference, frictional fit when taper 16 is forced into rout 30 so that web 12 bottoms out in rout 30. The preferred rout depth 34 is about ⅔ of thickness 26, resulting in a preferred rout depth 34 of about ½-inches. With a rout of this depth, web 12 extends through the lower density, softer core 26*a* of flange 22, so that thickness 14 of web 12 bears against the higher density, harder material found in the outer regions of OSL.

As discussed above, OSL often is not available in the lengths needed for most I-beams. Thus, a finger joint is indicated at 36, and is shown as a horizontal finger joint. Alternatively, finger joint 36 could be made as a vertical finger joint, or other geometries of joints could be used.

The joint between web 12 and inner flange 24 is indicated at 38 in FIG. 3. Joint 38, as discussed above, includes a frictional fit between web 12 and rout 30. This frictional fit is supplemented with an adhesive such as isocyanate or phenol resorcinol. Alternatively, other adhesives, or other fasteners, could be used.

Flanges 22 also include at least one outer flange 40 having a thickness 42 and a width 44 (FIG. 3). OSL similar to that used for inner flange 24 may be used for outer flange 40, but a stronger beam would result if outer flange 40 is made of a higher grade OSL. Higher grade OSL is made with longer strands, with the strands oriented to be closer to parallel with longitudinal axis 10*a*, or with a higher density, using more strands for a given panel thickness and higher press pressures. Alternatively, other engineered lumber such as LVL could be used. In the preferred embodiment, a single outer flange is used, with a thickness of about ¾-inches. A finger joint is indicated at 46.

Inner flange 24 is laminated to outer flange 40, defining a joint at 48. In the preferred embodiment, joint 48 is formed with an adhesive set while flanges 24 and 40 are pressed together before rout 30 is formed in inner flange 24. Fasteners other than adhesive could be used. The preferred adhesives include thermosetting resins such as phenolic or phenol resorcinol, or isocyanate. Alternatively, structural hot-melt glues such as polyamide or ethylene-vinyl acetate copolymer could be used.

The lamination of inner flange 24 to outer flange 40 in the preferred embodiment places the high density skin of outer flange 40 as a reinforcement to inner flange 24. This reinforcement increases the amount of high density OSL on which thickness 14 of web 12 bears. The resulting structure further increases the crush-resistance of the OSL used in flange 22.

As discussed above, finger joints 36 and 46 are potential points of weakness in flanges 24 and 40, respectively. If joints 36 and 46 are staggered in each flange 22 so that they are at least 2-inches apart, the adjacent, non-jointed portion of either inner flange 24 or outer flange 40 reinforces the point of weakness on outer flange 40 or inner flange 24, respectively. Preferably, the spacing between joints 36 and 46 in a particular flange 22 would be much greater than that. Dispersion of defects to regions of structural variation, such as a suboptimal concentration of adhesive relative to wood fibers or fluctuations in density that occurs occasionally as part of the manufacturing of OSL, is desirable as well. However, these regions can be difficult to locate, and are generally infrequent enough and of a small enough impact to the strength of either flange 24 or 40 that the natural staggering or randomization of such regions that occurs in the manufacturing process is sufficient to address this phenomenon.

For reference, a support for beam 10 is indicated generally at 60. Support 60 could be a header, column or foundation wall on which beam 10 rests.

Alternative embodiments of the invention include the use of types of engineered lumber other than OSL for flange 40. However, for maximum cost and production advantages, web 12, flange 24, and flange 40 typically are made out of the same material, thus requiring only a single type of production line to make an entire beam.

From the above-identified description of the elements of beam 10, various relationships can be described. For example, it can be described as a composite I-beam 10 having a pair of parallel flanges 22 and a web 12 extending therebetween. Flanges 22 may each include an inner laminate 24 of oriented strand lumber and an outer laminate 40 of engineered lumber, with web 12 extending more than halfway through each inner laminate 24 and being fastened thereto. Preferably, each flange 22 is formed of only two laminates 24 and 40, and inner and outer laminates 24 and 40 of each flange 22 are bonded to each other. Furthermore, both inner laminates 24 and outer laminates 40 are formed of oriented strand lumber. In an alternative embodiment, outer laminates 40 are formed of a higher grade of oriented strand lumber than used for inner laminates 24.

Described differently, I-beam 10 is formed substantially of wood fiber-based materials, and has two parallel flanges 22 and a web 12 extending therebetween. Each of flanges 22 is formed of an inner and an outer oriented strand lumber laminate, 24 and 40, respectively, adhered together. Web 12 is routed into and mounted to inner laminates 24, as shown in FIGS. 1 and 2.

Described still differently, I-beam 10 comprises a web 12, a first pair of flanges 24, and a second pair of flanges 40. Each flange 24 is preferably made of oriented strand lumber and fixed to web 12 so that web 12 is between flanges 24 and holds each flange 24 at a substantial distance from the other flange 24. One flange 40 is laminated to one flange 24, and the other flange 40 is laminated to the other flange 24.

Preferably, each flange 24 includes a tapered rout 30 into which a portion 16 of web 12 is inserted, and flanges 24 are located between flanges 40. Furthermore, each flange 24 is made of oriented strand lumber with a strand orientation of no more than about 20-degrees from longitudinal axis 10*a* of I-beam 10. For a stronger I-beam 10, flanges 24 may be made of oriented strand lumber with a strand orientation of no more than about 10-degrees from the longitudinal axis 10*a*. Flanges 40 may be made of oriented strand lumber, with a strand orientation as desired. An even stronger beam may be made with flanges 40 made of laminated veneer lumber.

Yet another description of I-beam 10 is as a beam having a defined moment of inertia, comprising: a web 12; an inner flange means 24 for increasing the moment of inertia of I-beam 10; and an outer flange means 40 for increasing the moment of inertia of I-beam 10. Inner flange means 24 is made of oriented strand lumber, and fixed to web 12 so that web 12 is held between inner flange means 24, as shown in FIGS. 1–3. Outer flange means 40 is laminated to inner flange means 24, as shown.

Modifications to the preferred and alternative embodiments can be made without departing from the scope of the present invention. These modifications are intended to be encompassed by the following claims.

I claim:

1. A composite I-beam having a pair of parallel flanges and a web extending therebetween, in which each of the flanges includes an inner laminate of oriented strand lumber and an outer laminate of engineered lumber, with the web extending more than halfway through each of the inner laminates and being fastened thereto.

2. The composite I-beam of claim 1 in which each of the flanges is formed of only two laminates, and the inner and outer laminates of each flange are bonded to each other.

3. The composite I-beam of claim 1 in which the outer laminates are formed of oriented strand lumber.

4. The composite I-beam of claim 1 in which the inner laminates are formed of oriented strand lumber and the outer laminates are formed of a higher grade of oriented strand lumber than the inner laminates.

5. A composite I-beam formed substantially of wood fiber-based materials having two parallel flanges and a web extending therebetween, each of the flanges being formed of an inner and an outer oriented strand lumber laminate adhered together, wherein the web is routed into and mounted to the inner laminates.

6. An I-beam comprising:

a web;

a first pair of flanges, each flange being made of oriented strand lumber and fixed to the web so that the web is between the first pair of flanges and holds each flange of the first pair at a substantial distance from the other flange of the first pair; and a second pair of flanges, with one flange of the second pair being laminated to one flange of the first pair, and the other flange of the second pair being laminated to the other flange of the first pair.

7. The I-beam according to claim 6, wherein each flange of the first pair includes a rout into which a portion of the web is inserted.

8. The I-beam according to claim 7, wherein the first pair of flanges is located between the second pair of flanges.

9. The I-beam according to claim 7, wherein the rout is tapered.

10. The I-beam according to claim 6, wherein the first pair of flanges is made of oriented strand lumber with a strand orientation of no more than about 20-degrees from the longitudinal axis of the I-beam.

11. The I-beam according to claim 6, wherein the first pair of flanges is made of oriented strand lumber with a strand orientation of no more than about 10-degrees from the longitudinal axis of the I-beam.

12. The I-beam according to claim 6, wherein the second pair of flanges is made of oriented strand lumber.

13. The I-beam according to claim 12, wherein the second pair of flanges is made of oriented strand lumber with a strand orientation of no more than about 20-degrees from the longitudinal axis of the I-beam.

14. The I-beam according to claim 12, wherein the second pair of flanges is made of oriented strand lumber with a strand orientation of no more than about 10-degrees from the longitudinal axis of the I-beam.

15. The I-beam according to claim 6, wherein the second pair of flanges is made of laminated strand lumber.

16. The I-beam according to claim 6, wherein the second pair of flanges is made of laminated veneer lumber.

17. The I-beam according to claim 6, wherein the first pair of flanges is fixed to the web by an adhesive selected from the group consisting of isocyanate and phenol resorcinol.

18. The I-beam according to claim 6, wherein the second pair of flanges is laminated to the first pair of flanges by an adhesive selected from the group consisting of phenol resorcinol, isocyanate, polyamide and ethylene-vinyl acetate copolymer.

19. An I-beam having a defined moment of inertia, the I-beam comprising:

a web;

an inner flange means for increasing the moment of inertia of the I-beam, the inner flange means being made of oriented strand lumber and fixed to the web so that the web is held between the inner flange means; and an outer flange means for increasing the moment of inertia of the I-beam, the outer flange means being laminated to the inner flange means.

* * * * *

UNITED STATES PATENT AND TRADEMARK OFFICE

CERTIFICATE OF CORRECTION

PATENT NO. : 6,012,262
DATED : January 11, 2000
INVENTOR(S) : Irving

It is certified that error appears in the above-identified patent and that said Letters Patent is hereby corrected as shown below:

Title page,
[*] delete "580" and insert -- 0 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*